US007148849B2

(12) United States Patent
Lin

(10) Patent No.: US 7,148,849 B2
(45) Date of Patent: Dec. 12, 2006

(54) MULTI-BAND ANTENNA

(75) Inventor: Huei Lin, Taoyuan (TW)

(73) Assignee: Quanta Computer, Inc., Tao Yuan Shien (TW)

( * ) Notice: Subject to any disclaimer, the term of this patent is extended or adjusted under 35 U.S.C. 154(b) by 15 days.

(21) Appl. No.: 10/995,476

(22) Filed: Nov. 24, 2004

(65) Prior Publication Data

US 2005/0134509 A1 Jun. 23, 2005

(30) Foreign Application Priority Data

Dec. 23, 2003 (TW) ..... 92136635 A

(51) Int. Cl.
*H01Q 1/38* (2006.01)

(52) U.S. Cl. ..... 343/700 MS; 343/702; 343/846

(58) Field of Classification Search ..... 34/702, 34/700 MS
See application file for complete search history.

(56) References Cited

U.S. PATENT DOCUMENTS 6,734,825 B1 * 5/2004 Guo et al. ..... 343/700 MS
6,812,892 B1 * 11/2004 Tai et al. ..... 343/700 MS
6,844,853 B1 * 1/2005 Tai et al. ..... 343/700 MS
6,861,986 B1 * 3/2005 Fang et al. ..... 343/700 MS
6,864,845 B1 * 3/2005 Kuo et al. ..... 343/702
2003/0189522 A1 * 10/2003 Zeilinger ..... 343/702
2004/0104853 A1 * 6/2004 Chen ..... 343/702
2005/0190108 A1 * 9/2005 Lin et al. ..... 343/702

* cited by examiner

*Primary Examiner*—Trinh Vo Dinh
(74) *Attorney, Agent, or Firm*—Rabin & Berdo, PC

(57) ABSTRACT

A multi-band antenna having a low frequency operating band and a high frequency operating band is provided. The multi-band antenna includes a radiating element, a grounding plane, a short-circuiting element and a short-circuiting regulator. The radiating element has a feed-in point for transmitting signals and several radiation arms. The first and the second radiation arms respectively have a first resonant mode and a second resonant mode which jointly generate a high frequency operating band, while the third radiation arm has a third resonant mode which generates a low frequency operating band. The grounding plane is connected to the radiating element via the short-circuiting element to miniaturize the scale of the antenna. The short-circuiting regulator of the grounding plane enhances the impedance matching when high frequency resonance occurs.

20 Claims, 6 Drawing Sheets

MULTI-BAND ANTENNA

This application claims the benefit of Taiwan application Serial No. 92136635, filed Dec. 23, 2003, the subject matter of which is incorporated herein by reference.

BACKGROUND OF THE INVENTION

1. Field of the Invention

The invention relates in general to an antenna, and more particularly to a multi-band antenna.

2. Description of the Related Art

In wireless communication system, antenna serves as a medium for the transmission and reception of electromagnetic signals, and the electrical characteristics of an antenna influence the quality of telecommunication. When in service, ordinary antennae are always bothered by multi-path interference problem. To solve this problem, one of the solutions is to improve the quality and performance of signal transmission/reception by means of antenna diversity structure. When the system is operating under a single frequency band, the user may use two or more sets of single band antenna to form an antenna diversity system. For example, the 5 GHz frequency band used in WLAN 802.11a or the 2.4 GHz frequency band used in WLAN 802.11b, a master antenna and a slave antenna are provided to achieve antenna diversity. The master antenna transmits and receives signals, while the slave antenna can only receive signals. Thus, one of the antennae can be selected to receive signals according to the signal intensity. Besides, WLAN 802.11 g operated in the 2.4 GHz frequency band is equipped with two antennae, both of which have transmitting and receiving functions but which one is to be selected depends on the quality of the signals so as to transmit/receive electromagnetic waves coming from different directions.

When the system adopts a dual-band or even a multi-band operation, most antenna systems will adopt a design of using plural sets of independent antennae or using a combined antenna set to achieve antenna diversity so that the excellent characteristics of signals in various bands may be maintained. Therefore at least four sets of antennae are required to meet the operating frequency ranges needed for the operation of the WLAN 802.11a/b/g, namely, 2.4~2.4835 GHz, 5.15~5.35 GHz, 5.47~5.725 GHz and 5.725~5.825 GHz. Obviously, such a design will largely increase the complexity of the radio frequency system (RF system), reduce operation reliability, and increase manufacturing costs.

Unlike the above design, the design of multi-band antenna uses the second harmonic generation (SHG) effect of a resonant structure to create several resonant modes whereby the object of multi-band operation is achieved. However, such a design has inherent restrictions, i.e., a multiple relationship exists among the central frequency of each resonant mode and that all of the frequency bands are narrow whose bandwidth is hard to expand. For example, in the dual-band antenna of 2.4 GHz and 5 GHz frequency bands used in ordinary WLAN, the designer simply adjusts the structural parameters of the double frequency resonant mode, whose frequency band is 4.8 GHz, to be used for the transmission/reception of 5 GHz electromagnetic signals. Consequently, the transmission efficiency of electromagnetic waves in high frequency range is normally poor, affecting signal quality greatly. Due to the restriction of the multiple relationship among resonant modes, the above design cannot be applied in WLAN 802.11a/b/g whose operating frequency ranges are 2.4~2.4835 GHz'5.15~5.35 GHz'5.47~5.725 GHz and 5.725~5.825 GHz because multiple relationship does not exist among the bands of 5 GHz frequency ranges. Furthermore, the overall bandwidth, which is near 1 GHz, is too wide. With regard to the application in WLAN 802.11a/b and WLAN 802.11a/g under these circumstances, how to develop an antenna covering the operating characteristics of various frequency bands and having the advantages of small size at the same time has become a hard-to-break-through bottleneck for designers.

SUMMARY OF THE INVENTION

It is therefore an object of the invention to provide a multi-band antenna, which uses a single antenna body manufactured into a unity to produce multi-band operating characteristics and when combined with a shielding metal provides the system with excellent high frequency characteristics and electromagnetic compatibility even when disposed in a small space.

According to the objects of the invention, a multi-band antenna with both a low frequency operating band and a high frequency operating band is provided and described below.

The multi-band antenna includes a radiating element, a grounding plane, a short-circuiting element and a short-circuiting regulator. The radiating element has a feed-in point for transmitting signals and several radiation arms. Of which, the first radiation arm and the second radiation arm respectively have a first resonant mode and a second resonant mode which jointly generate a high frequency operating band, while the third radiation arm has a third resonant mode which generate a low frequency operating band. The grounding plane is connected to the radiating element via the short-circuiting element to miniaturize the scale of the antenna. The short-circuiting regulator of the grounding plane improves the impedance when high frequency resonance occurs. In practical application, a coaxial line can be used to transmit the signals, of which, the core wire of the coaxial line is coupled to the radiating element at the feed-in point while the outer conductor of the coaxial line is coupled to the grounding point of the grounding plane.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1A:
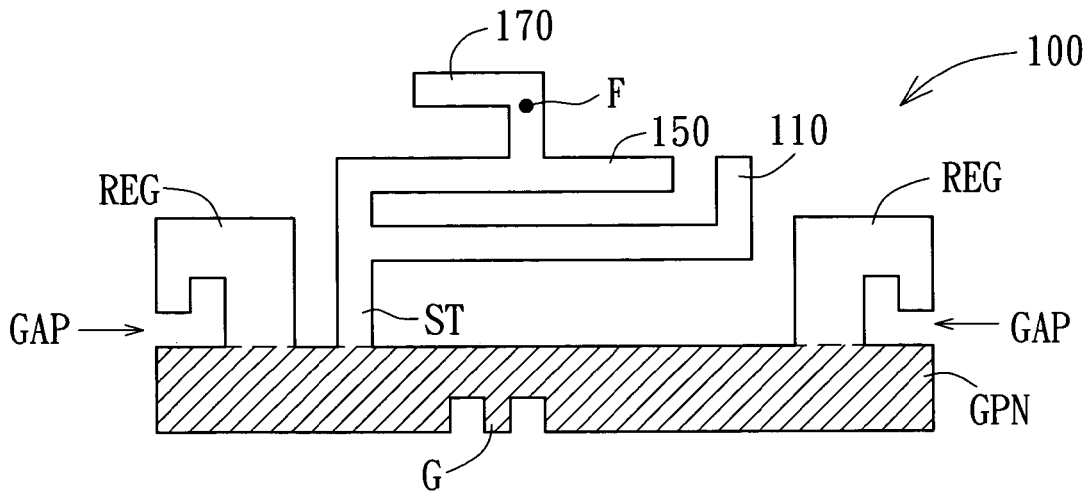
FIG. 1A is a multi-band antenna according to a preferred embodiment of the invention.

Referring to FIG. 1A, a schematic diagram of a multi-band antenna according to a preferred embodiment of the invention is shown. Multi-band antenna 100 whose antenna body is manufactured into a unity includes a radiating element, a grounding plane GPN, a short-circuiting element ST and a short-circuiting regulator REG. The radiating element, which includes radiation arms 110, 150 and 170, enables the multi-band antenna 100 to have multi-band operating characteristics. As for how the multi-band antenna 100 meets the operating bandwidth requirement for the operation of the 2.4 GHz frequency band and the 5 GHz frequency band in the application of WLAN 802.11a/b and WLAN 802.11a/g is described below. For convenience, the frequency range of 2.4~2.4835 GHz is defined as low frequency operating band while the frequency range of 5.15~5.825 GHz is defined as high frequency operating band to meet the requirement in the design of multi-band operation.

Figure 1B:
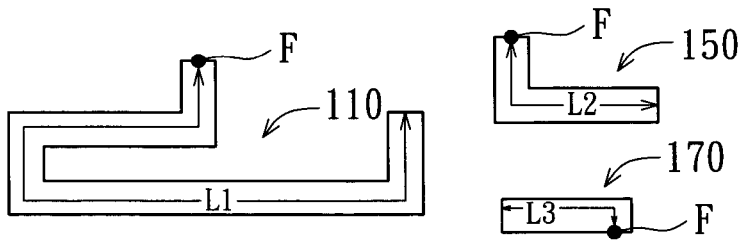
FIG. 1B is a decomposition of the radiation arms in FIG. 1A.

With regard to signal transmission, both the feed-in point F on the radiating element and the grounding point G on the grounding plane GPN are contact points between the multi-band antenna 100 and the transmission line. Taking the application of coaxial line for example, the core wire of the coaxial line may be soldered onto the radiating element at the feed-in point F while the outer conductor of the coaxial line may be connected to the grounding point G. Examining the radiating element further, it can be seen that the radiating element includes radiation arms 110, 150 and 170. The decomposition of these radiation arms is shown in FIG. 1B. In terms of length, the radiation arm 110 is the longest; the radiation arm 150 comes second while the radiation arm 170 is the shortest. So the design of the electric current path L1 of the radiation arm 110, which starts with the open end and ends at the feed-in point F, is based on the frequency resonance of the 2.4 GHz such that the resonant mode of the radiation arm 110 enables the multi-band antenna 100 to meet the design requirements of low frequency operating band.

Since the multi-band antenna 100 requires a wide bandwidth of the 5 GHz frequency band, the invention uses the radiation arm 150 and the radiation arm 170 to respectively provide the corresponding frequency characteristics of the high frequency operating band. That is to say, the operating bandwidths of two radiation arms are designed to be partially overlapped (for example, the radiation arm 150 has a bandwidth of 5.15~5.5 GHz while the radiation arm 170 has a bandwidth of 5.4~5.825 GHz) so as to jointly meet the bandwidth requirement of the 5 GHz frequency band. In other words, the bandwidth of the 5 GHz frequency band is contributed by the radiation arm 150 and the radiation arm 170. In practical application, the radiation arm 150 and the radiation arm 170 may form a Z-shaped symmetric structure to expand the bandwidth; the electric current path L2, starting from the open end of the radiation arm 150 and ending at the feed-in point F, is aimed to generate the resonance around 5.3 GHz so that the resonant mode of the radiation arm 150 may meet the bandwidth requirement of 5.15~5.5 GHz. On the other hand, the design of the electric current path L3, starting from the open end of the radiation arm 170 and ending at the feed-in point F, is based on the resonance around 5.6 GHz so that the resonant mode of the radiation arm 170 may meet the bandwidth requirement of 5.4~5.825 GHz.

Figure 2A:
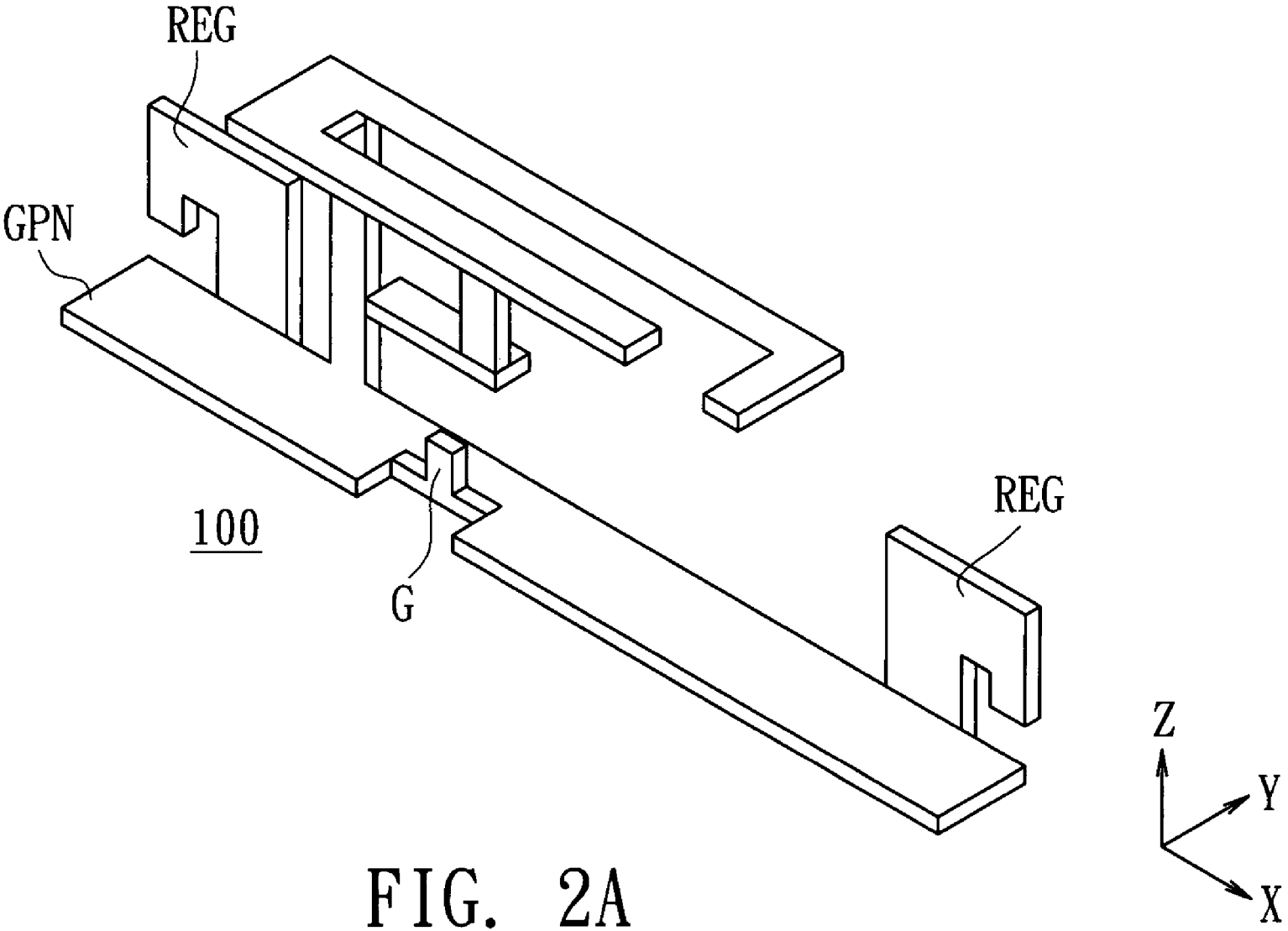
FIG. 2A is a schematic diagram of a folded multi-band antenna.

Another key point of the antenna structure lies in the disposition of the short-circuiting element ST. The short-circuiting element ST may short-circuit the radiating element with the grounding plane GPN, producing a short-circuit effect which is similar to the structure of a planar inverted F antenna (PIFA) and is conducive to miniaturizing the scale of the antenna. Moreover, because of the separation between the short-circuiting element ST and the grounding point G the interference between the 2.4 GHz frequency band and the 5 GHz frequency band can be reduced so as to optimize the radio frequency characteristic thereof. To further miniaturize the scale of antenna, the short-circuiting element ST, the radiation arms 110, 150 and 170, the short-circuiting regulator REG, the grounding plane GPN and the grounding point G may be folded up in practical application as shown in FIG. 2A.

Figure 2B:
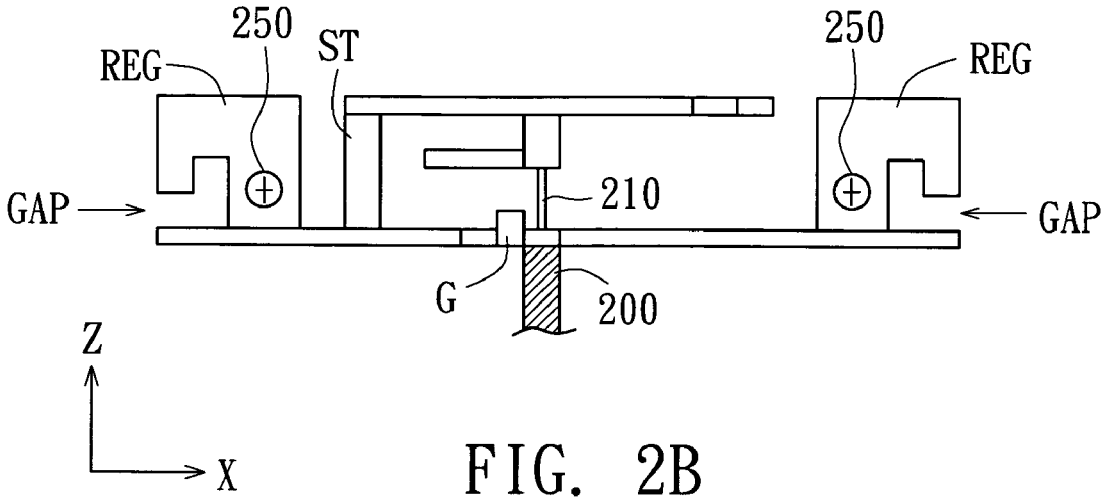
FIG. 2B shows the coupling of the folded multi-band antenna and a coaxial line.

Referring to FIG. 2B, a schematic diagram of the coupling between the folded multi-band antenna 100 and the coaxial line 200 is shown. The core wire 210 of the coaxial line 200 is coupled to the radiating element at the feed-in point F, while the outer conductor (not shown here) of the coaxial line is coupled to the grounding point G of the grounding plane for grounding. It is noteworthy that the screw 250 may short-circuit the short-circuiting regulator REG with the shielding metal to increase the cross section area of the electromagnetic field and improve the quality of signal transmission/reception (the detailed explanation with accompanied by diagrams is given below). On the other hand, a gap exists between the short-circuiting regulator REG and the grounding plane GPN, so the short-circuiting regulator REG may be regarded as an extension of the grounding plane GPN, and the gap is conducive to the impedance matching of the multi-band antenna 100. Particularly the return loss of the 5 GHz frequency band is significantly improved when the short-circuiting regulator REG is incorporated in the design.

Figure 3:
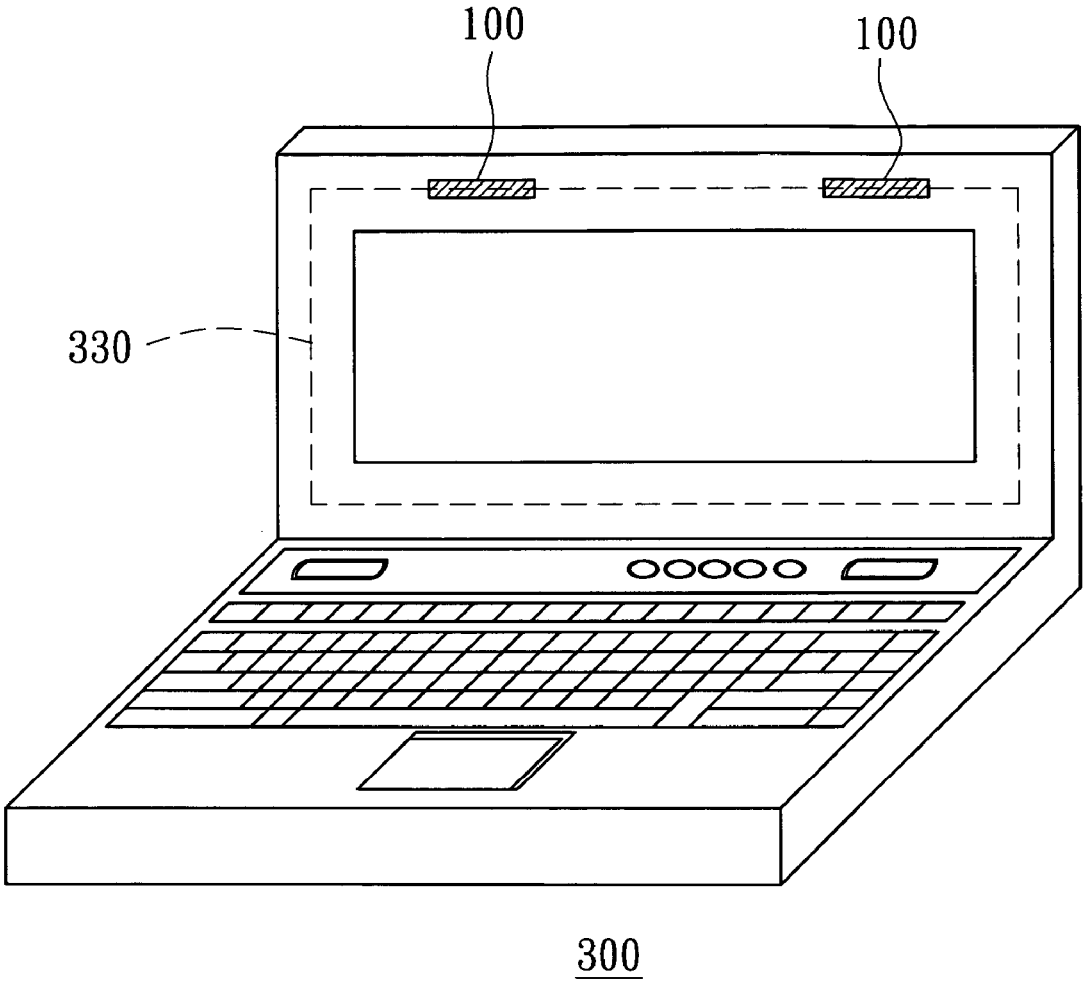
FIG. 3 shows the disposition of a multi-band antenna within a notebook computer.

Referring to FIG. 3, a schematic diagram of the disposition of a multi-band antenna within a notebook computer is shown. A shielding metal 330 is disposed within a notebook computer 300 for reducing electromagnetic interference and for enhancing the anti-interference characteristic. In practical application, a number of multi-band antenna 100 (two are used in the present preferred embodiment) may be used to form an antenna diversity structure, and are fastened to the shielding metal 330 by a screw 250 so as to increase the surface area of the antenna, enabling the multi-band antenna 100 to produce a better reception (or transmission) effect. In a broad sense, the shielding metal 300 has become part of the antenna element, contributing to a better signal reception. If this effect can be considered and incorporated in antenna design, the optimization of the transmission and reception performance of the notebook computer 300 will be achieved. Furthermore, separately disposing the multi-band antennas 100 at two opposite ends of the notebook computer not only reduces the interference of signal transmission/reception but also enhances the spatial diversity of the antennae.

Figure 4:
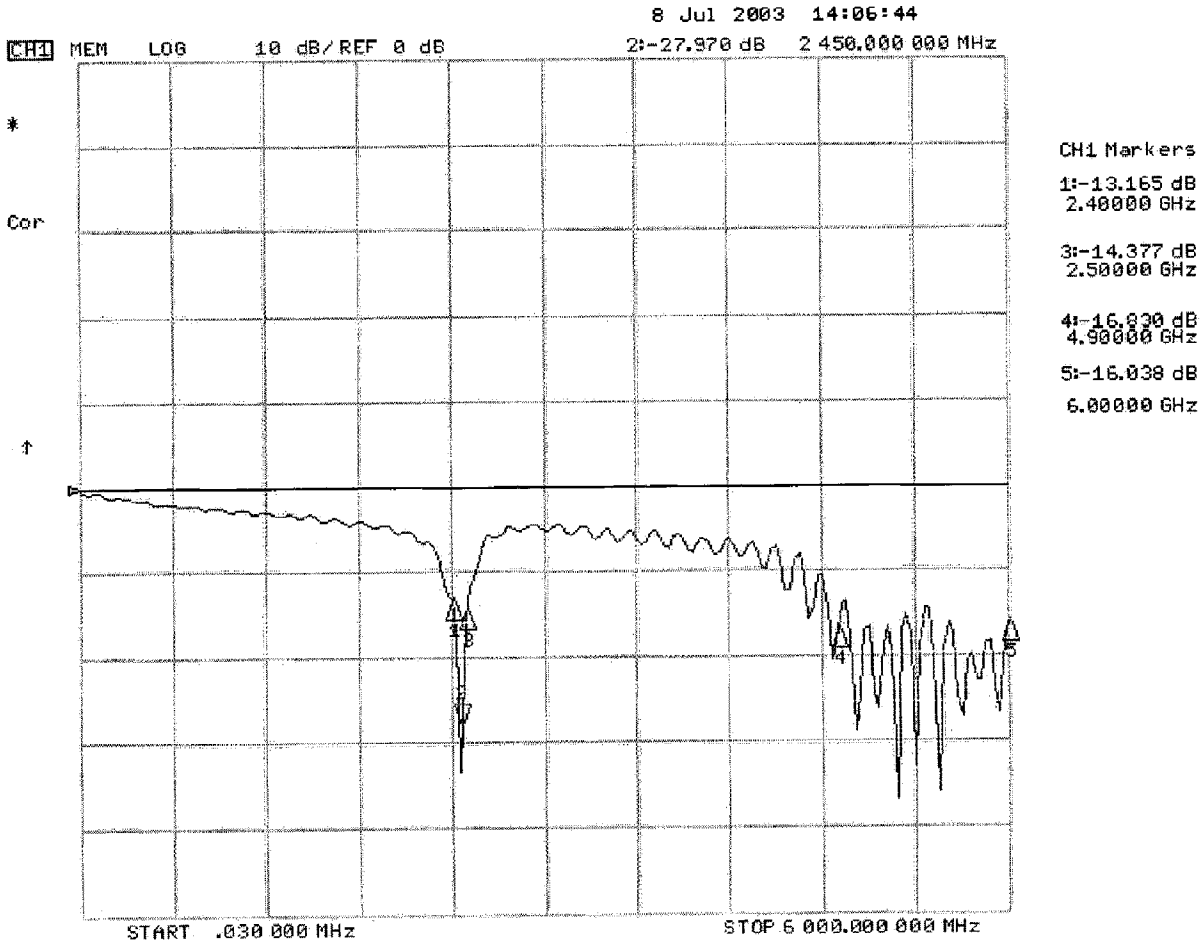
FIG. 4 is a diagram showing the measurement of return loss of a multi-band antenna according to the invention.

Referring to FIG. 4, a diagram showing the measurement of the return loss of a multi-band antenna according to the invention is illustrated. With regard to low frequency band, it can be seen from label 1, label 2 and label 3 that the return loss for operating frequencies ranging from 2.4~2.5 GHz are all under −10 dB with the return loss for the central frequency being about −27.97 dB. With regard to high frequency band, the return loss for operating frequencies ranging from 5.15~5.825 GHz are all under −10 dB. The available frequency band can even range from 4.9 GHz to 6

GHz, a range already covering the specification of 4.9 GHz frequency band adopted in areas such as Japan and Australia, whose return loss as shown in label 4 and label 5 are still under −10 dB. It can be said that under an excellent impedance matching, a frequency bandwidth as wide as 1 GHz can be generated in the 5 GHz frequency band. With regard to the 2.4 GHz frequency band, within the operating frequencies of WLAN802.11b or WLAN 802.11g, ranging from 2.4 GHz to 2.4835 GHz, the return loss are all under −10 dB. In terms of specification, the high frequency operating band of the antenna according to the invention covers three different frequency bands, namely, 5.15~5.35 GHz, 5.47~5.725 GHz and 5.725~5.825 GHz. In other words, the multi-band antenna according to the invention, which is manufactured into a unity, can radiate electromagnetic waves in at least four frequency bands via a single resonant structure.

Referring to both Table 1 and Table 2, the measurement of antenna gain as the multi-band antenna is operated in low frequency band of 2.4 GHz and high frequency band of 5 GHz respectively are shown. Of which, the antenna is disposed along the X-axis in FIG. 2A and FIG. 2B to measure the gain value on the X-Y plane. Judging from the fact that the peak gains for various frequencies of the 2.4 GHz frequency band are near 0 dB while that of the 5 GHz frequency band range from 0.93 to 3.79 dB, it can be understood that the radiation field pattern of the 2.4 GHz frequency band is close to a circular-shaped smooth contour while that of the 5 GHz frequency band is close to an oval-shaped contour. Moreover, the average gains for various frequencies of the 2.4 GHz frequency band are larger than −2.8 dB while those of the 5 GHz frequency band are larger than −3.5 dB. All of these data prove that the antenna according to the invention has excellent radiation efficiency.

TABLE 1

| Frequency Range | 2.4 GHz Frequency Band | | |
|---|---|---|---|
| Frequency (GHz) | 2.40 | 2.45 | 2.4835 |
| Peak Gain (dBi) | 0.14 | −0.47 | 0.6 |
| Average Gain (dBi) | −2.39 | −2.75 | −2.53 |

TABLE 2

| Frequency Range | 5 GHz Frequency Band | | | | |
|---|---|---|---|---|---|
| Frequency (GHz) | 4.9 | 5.15 | 5.25 | 5.35 | 5.47 |
| Peak Gain (dBi) | 3.71 | 3.79 | 3.56 | 3.60 | 3.23 |
| Average Gain (dBi) | −3.10 | −3.13 | −2.78 | −2.11 | −1.85 |
| Frequency (GHz) | 5.5975 | 5.725 | 5.775 | 5.825 | |
| Peak Gain (dBi) | 1.35 | 1.64 | 1.08 | 0.93 | |
| Average Gain (dBi) | −2.34 | −2.12 | −2.36 | −2.90 | |

Figure 5:
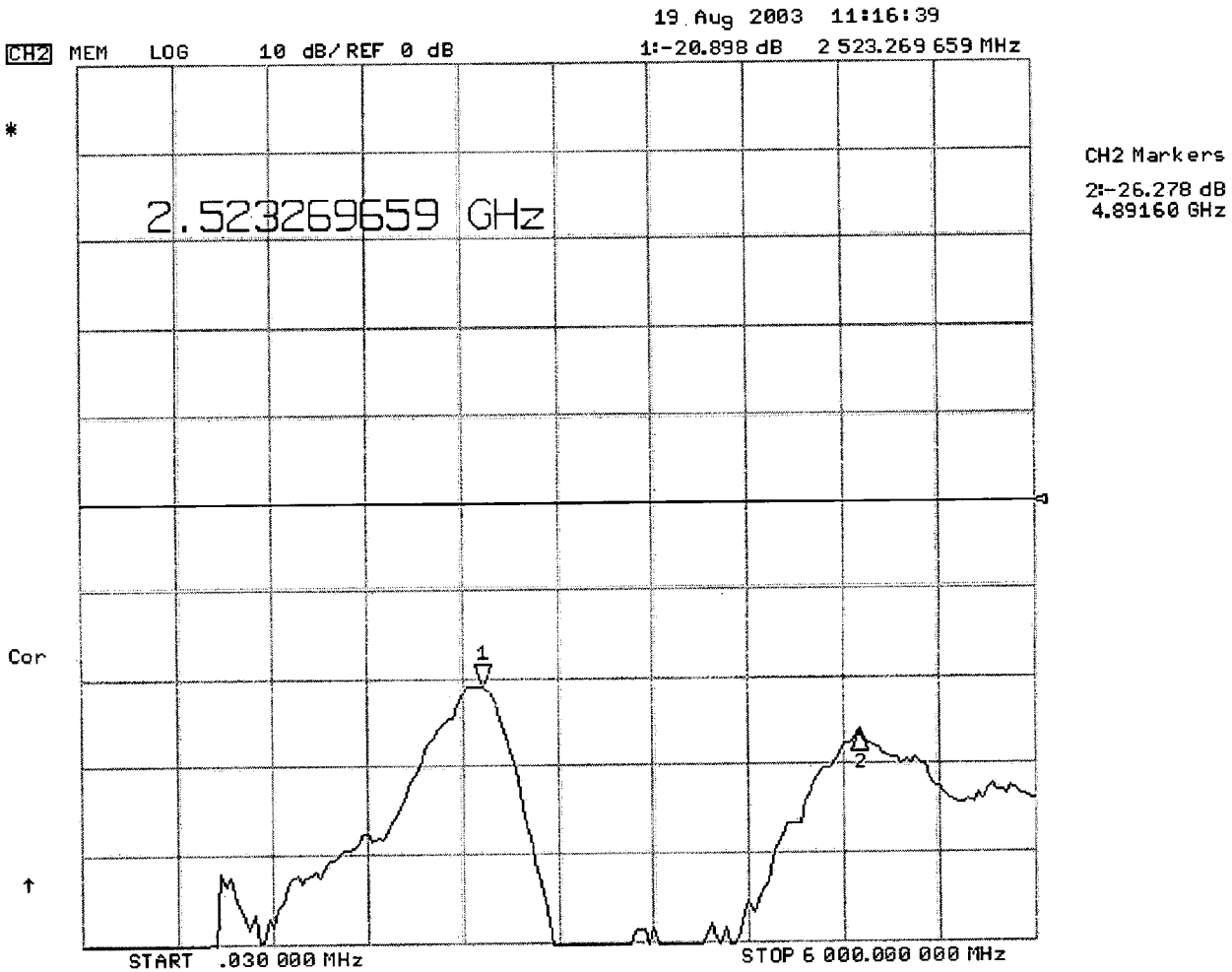
FIG. 5 is a diagram showing the measurement of the isolation test of a multi-band antenna according to the invention.

Referring to FIG. 5, the measurement of the isolation test of a multi-band according to the invention is shown. Electromagnetic signals are transmitted by antenna A and are received by antenna B so as to detect the isolation characteristic of electromagnetic waves. FIG. 5 illustrates the isolation of signal transmission between the two antennae 100 in FIG. 4. The RF electricity isolation of the dual-antenna system as operated at the frequencies, 2.52 GHz and 4.89 GHz, is respectively −20.0 dB and −26.28 dB, which shows an excellent isolation effect.

According to the above disclosure, the multi-band antenna according to the invention has at least the following advantages:

1. The antenna body is a manufactured-into-a-unity conductor structure, conducing to reduce manufacturing cost and increasing the stability of the antenna in high frequency characteristics;

2. By incorporating two radiation arms whose lengths are approximately equal, the excellent impedance matching and bandwidth expansion can be achieved;

3. By using the short-circuiting element to connect the radiating element and the grounding plane, the volume of the antenna may be effectively reduced;

4. The short-circuiting regulator may improve the impedance matching of high frequency mode;

5. With the electrical connection of the antenna and the shielding metal, the electromagnetic radiation efficiency is increased, and with the electromagnetic compatibility, the high frequency performance of the system is also increased; and 6. The antenna according to the invention is simple in structure and small in size, so is ideal for a concealed type antenna system.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A multi-band antenna with a high frequency operating band and a low frequency operating band, comprising:

a radiating element, having a feed-in point for transmitting signals and a plurality of radiation arms, wherein the radiation arms comprise:

a first radiation arm, coupled to the feed-in point, having a first resonant mode;

a second radiation arm, having a length that is different than a length of the first radiation arm, and being coupled to the feed-in point and having a second resonant mode, wherein the first resonant mode and the second resonant mode jointly generate the high frequency operating band, and the operating bandwidths of the first radiation arm and the second radiation arm being different, and partially overlapping each other; and a third radiation arm, coupled to the feed-in point, having a third resonant mode for generating the low frequency operating band;

a grounding plane, having a grounding point; and a short-circuiting element, for coupling the radiating element to the grounding plane.

2. The multi-band antenna according to claim 1, wherein the first radiation arm forms a symmetric structure with the second radiation arm.

3. The multi-band antenna according to claim 2, wherein the symmetric structure is a Z-shaped structure.

4. The multi-band antenna according to claim 1, wherein the high frequency operating band belongs to the 5 GHz frequency band.

5. The multi-band antenna according to claim 1, wherein the low frequency operating band belongs to the 2.4 GHz frequency band.

6. The multi-band antenna according to claim 1, wherein the radiating element, the grounding plane and the short-circuiting element are manufactured into a unity.

7. A multi-band antenna with a high frequency operating band and a low frequency operating band, comprising:

a radiating element, having a feed-in point for transmitting signals and a plurality of radiation arms, wherein the radiation arms comprise:

a first radiation arm, coupled to the feed-in point, having a first resonant mode;

a second radiation arm, coupled to the feed-in point, having a second resonant mode, wherein the first resonant mode and the second resonant mode jointly generate the high frequency operating band; and a third radiation arm, coupled to the feed-in point, having a third resonant mode for generating the low frequency operating band;

a grounding plane, having a grounding point;

a short-circuiting element, for coupling the radiating element to the grounding plane: and a short-circuiting regulator, wherein the short-circuiting regulator is coupled to the grounding plane and forms a gap to enhance the impedance matching of the multi-band antenna under both the high frequency operating band and the low frequency operating band.

8. The multi-band antenna according to claim 7, wherein the high frequency operating band belongs to the 5 GHz frequency band while the low frequency operating band belongs to the 2.4 frequency band.

9. The multi-band antenna according to claim 7, wherein the first radiation arm forms a Z-shaped structure with the second radiation arm.

10. The multi-band antenna according to claim 7, wherein the radiating element, the grounding plane, the short-circuiting element and the short-circuiting regulator are manufactured into a unity.

11. A notebook computer comprising:

a shielding metal, for reducing electromagnetic interference; and a multi-band antenna, having a high frequency operating band and a low frequency operating band, the antenna comprising:

a radiating element, having a feed-in point for transmitting signals and a plurality of radiation arms, wherein the radiation arms comprise:

a first radiation arm, coupled to the feed-in point, having a first resonant mode;

a second radiation arm, coupled to the feed-in point and having a second resonant mode, wherein the first resonant mode and the second resonant mode jointly generate the high frequency operating band, and the operating bandwidths of the first radiation arm and the second radiation arm are different and partially overlap each other; and a third radiation arm, coupled to the feed-in point and having a third resonant mode for generating the low frequency operating band;

a grounding plane, coupled to the shielding metal and having a grounding point; and a short-circuiting element, for coupling the radiating element to the grounding plane, wherein the short-circuiting element, the grounding point, the first radiation arm, the second radiation arm and the third radiation arm are folded up.

12. The notebook computer according to claim 11, wherein the first radiation arm forms a symmetric structure with the second radiation arm.

13. The notebook computer according to claim 12, wherein the symmetric structure is a Z-shaped structure.

14. The notebook computer according to claim 11, wherein the high frequency operating band belongs to the 5 GHz frequency band.

15. The notebook computer according to claim 11, wherein the low frequency operating band belongs to the 2.4 GHz frequency band.

16. The notebook computer according to claim 11, wherein the radiating element, the grounding plane and the short-circuiting element are manufactured into a unity.

17. A notebook computer comprising:

a shielding metal, for reducing electromagnetic interference; and a multi-band antenna, having a high frequency operating band and a low frequency operating band, the antenna comprising:

a radiating element, having a feed-in point for transmitting signals and a plurality of radiation arms, wherein the radiation arms comprise:

a first radiation arm, coupled to the feed-in point, having a first resonant mode;

a second radiation arm, coupled to the feed-in point and having a second resonant mode, wherein the first resonant mode and the second resonant mode jointly generate the high frequency operating band; and a third radiation arm, coupled to the feed-in point and having a third resonant mode for generating the low frequency operating band;

a grounding plane, coupled to the shielding metal and having a grounding point;

a short-circuiting element, for coupling the radiating element to the grounding plane; and a short-circuiting regulator, wherein the short-circuiting regulator is coupled to the grounding plane and forms a gap to enhance the impedance matching of the multi-band antenna under both the high frequency operating band and the low frequency operating band.

18. The notebook computer according to claim 17, wherein the high a frequency operating band belongs to the 5 0GHz frequency band while the low frequency operating band belongs to the 2.4 frequency band.

19. The notebook computer according to claim 17, wherein the first radiation arm forms a Z-shaped structure with the second radiation arm.

20. The notebook computer according to claim 17, wherein the radiating element, the grounding plane, the short-circuiting element and the short-circuiting regulator are manufactured into a unity.

* * * * *